United States Patent [19]

Marshall et al.

[11] 4,131,327

[45] Dec. 26, 1978

[54] PORTABLE PICNIC AND CAMPING CABINET TABLE

[76] Inventors: Esther L. Marshall; William B. Allen, both of 7031 E. Orme, Wichita, Kans. 67207

[21] Appl. No.: 857,031

[22] Filed: Dec. 2, 1977

[51] Int. Cl.[2] ..... A47F 5/08

[52] U.S. Cl. ..... 312/241; 312/244

[58] Field of Search ..... 312/237, 240, 241, 286, 312/324, 244; 288/188.6; 108/125, 129

[56] References Cited

U.S. PATENT DOCUMENTS

| | | | |
|---|---|---|---|
| 1,225,958 | 5/1917 | Hopwood | 312/241 |
| 1,325,371 | 12/1919 | Otteson | 312/241 |
| 1,421,541 | 7/1922 | Nolty | 108/129 |
| 3,082,025 | 3/1963 | Larson | 108/129 |
| 3,331,647 | 7/1967 | Stryebin et al. | 312/241 |
| 3,543,890 | 12/1970 | Criswell | 312/241 |

FOREIGN PATENT DOCUMENTS

| | | | |
|---|---|---|---|
| 43-155 | 4/1968 | Japan | 108/129 |
| 701495 | 12/1953 | United Kingdom | 312/241 |

*Primary Examiner*—Kenneth Downey
*Attorney, Agent, or Firm*—John H. Widdowson

[57] ABSTRACT

A portable picnic and camping cabinet table for storing picnic and camping supplies therein. The cabinet table converting into an outdoor kitchen when set up and providing room for serving meals thereon.

4 Claims, 7 Drawing Figures

PORTABLE PICNIC AND CAMPING CABINET TABLE

BACKGROUND OF THE INVENTION

The subject invention relates generally to a cabinet used for a picnic and camping and more particularly, but not by way of limitation, to a combination cabinet and table which may be set up on level and unlevel ground surfaces and used for an outdoor kitchen.

Heretofore there have been similar portable kitchens, camping furniture, and camp tables. In particular U.S. Pat. No. 1,716,584 to Hahn and U.S. Pat. No. 1,325,371 to Otteson disclose cabinets that convert from a storage cabinet into a table. Also in U.S. Pat. No. 2,944,862 to Heil, a portable kitchen is shown having foldable legs attached to the bottom of a storage cabinet. In U.S. Pat. No. 2,448,377 to Lindner and U.S. Pat. No. 1,413,136 to Schmitt, cabinets having collapsible legs and foldable sides are shown.

While the above patents disclose similar types of cabinets used for picnics, camping, or the like, none of them disclose the specific features and advantages as described herein.

SUMMARY OF THE INVENTION

The subject invention is compact and fully portable for storing picnic and camping supplies therein. When the cabinet table is set up, it provides an outdoor kitchen forming a table, storage for food products, support for a camping stove, and support for a camp lantern or any other camping supplies.

The invention includes telescoping adjustable legs so that the cabinet table may be leveled on an unlevel ground surface. Further, the legs are fully retractable and fold upwardly adjacent the sides of the cabinet housing for ease in transporting and storing the cabinet table. Also, the legs may be extended outwardly in a horizontal position for carrying the housing from one location to another.

The invention is lightweight, rugged in design, and folds up into a compact enclosed housing for ease in transporting and taking a minimum amount of storage space.

The portable picnic and camping cabinet table includes a cabinet housing having a horizontal shelf therein for storing supplies, the housing includes a top portion, a bottom portion, end portions, and foldable side portions. The foldable side portions are hingeably attached to the bottom of the housing and form a table surface when folded outwardly from the housing. Four telescoping legs are mounted at the corners of the bottom of the side portions of the housing. The legs, when raised into a horizontal position, are disposed against the bottom of the side portions of the housing. When the legs are lowered, the length of the legs may be adjusted for an unlevel ground surface. A pair of horizontal parallel retractable extension rods are slidably received at the bottom of one of the end portions of said housing. When the rods are pulled outwardly, a camp stove or the like may be supported thereon.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
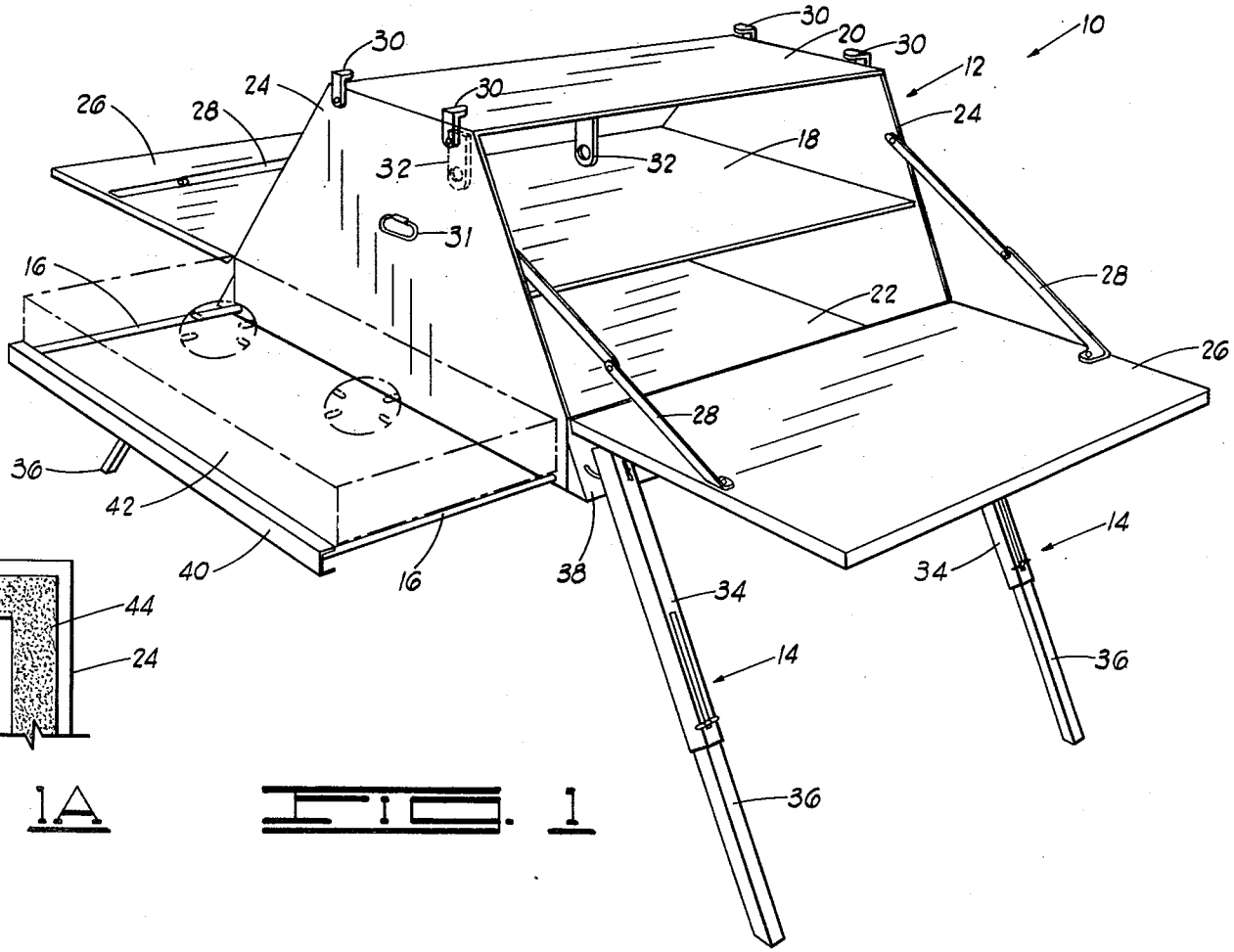
FIG. 1 is a perspective view of the cabinet table.

In FIG. 1, the portable picnic and camping cabinet table is designated by general reference numeral 10. The cabinet table 10 includes a cabinet housing 12, telescoping legs 14, and a pair of horizontal parallel retractable extension rods 16.

The housing 12 includes a horizontal shelf 18 for storing picnic and camping supplies thereon, a top portion 20, a bottom portion 22 which may act also as a shelf for receiving supplies thereon, end portions 24, and side portions 26 hingeably attached to the bottom of the housing 12 and forming a table surface when folded outwardly from the housing 12.

The foldable side portions 26 are attached to one end of foldable braces 28. The other end of the foldable braces 28 are attached to the inside of the end portions 24 so that when the side portions 26 are folded upwardly against the side of the housing 12, the foldable braces 28 are folded inside the housing 12. This feature of providing the foldable braces 28 so that they are folded inside the housing 12 eliminate the unsightliness of the braces 28 being attached outside the housing 12 and eliminating the chance of the braces 28 being bent or torn loose from the housing 12 and clothing being snagged thereon.

When the side portions 26 are folded against the housing 12, they are held in place by fastening buckles 30 which are pivotally attached to the top of the end portions 24. While the buckles 30 are shown, it should be appreciated that various types of fasteners and locks may be used for securing and locking the side portions 26 to the housing 12 and preventing pilferage of the cabinet table 10 or loss of goods falling out of the housing 12 should the side portions 26 come loose during the transporting of the cabinet table 10.

Attached to both of the end portions 24 are handles 31 used for lifting and transporting the cabinet table 10. Also disposed inside the housing 12 and mounted to the top portion 20 is a foldable towel rack 32 which is used for holding paper towels during the use of the cabinet housing 10.

The telescoping legs 14 include a hollow foldable upper leg 34 and a telescoping lower leg 36 which is slidably received in one end of the upper leg 34. The upper end of the upper leg 34 is pivotally attached to a leg bracket 38 which allows the legs 14 to be pivoted 180° on the housing 12. By raising and lowering the telescoping lower leg 36 in the upper leg 34, the cabinet table 10 may be adjusted for unlevel ground conditions.

The parallel horizontal retractable extension rods 16 are slidably received in the bottom of one of the end portions 24 of the housing 12. Attached to the ends of the rods 16 is a transverse rod support 40 which adds rigidity to the strength of the rods and prevents various camping articles from falling off the ends of the rods 16. In FIG. 1, a camping stove 42 is shown received on top of the rods 16. The stove 42 is shown in dotted lines. The rod support 40 has an inverted "L" shaped structure for providing a hand grasp for ease in sliding the extension rods 16 in and out of the housing 12. When the camping stove 42 is removed, the support 40 is grasped by the hand and the extension rods 16 are slid inwardly into the inside of the housing 12 until the rod support 40 rests against the side of the end portion 24.

Figure 1A:
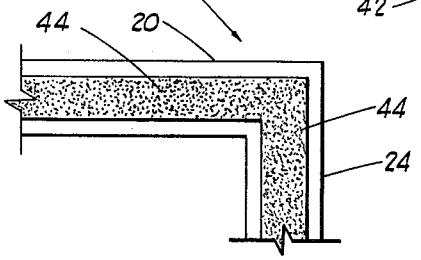
FIG. 1A is a partial view of the cabinet housing showing a foam rubber strip along the edges of the housing.

In FIG. 1A, an exploded partial view of a portion of the top portion 20 and end portion 24 of the cabinet housing 12 is illustrated to show foam rubber strips 44 placed on the edges of the end portion 24 and top portion 20 so that when the side portions 26 are folded against the cabinet housing 12, they are compressed against the foam rubber strips 44 providing an air-tight cabinet housing 12 to prevent insects, etc., from obtaining access into the inside of the housing 12.

Figure 2:
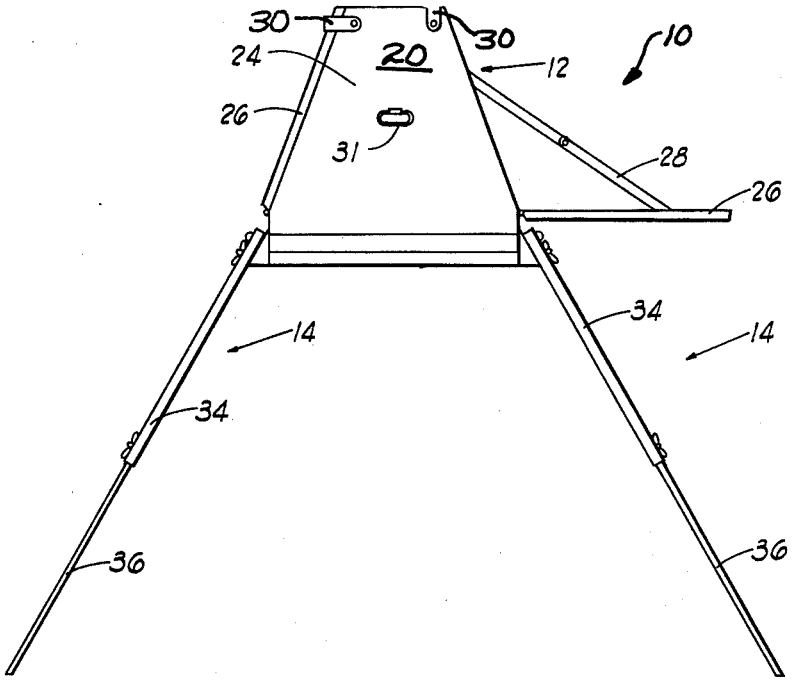
FIG. 2 is an end view of the cabinet table with the telescoping legs lowered in a fully extended position.

In FIG. 2, an end view of the cabinet table 10 is illustrated. In this view, the right hand side portion 26 is lowered outwardly on braces 28. The side portion 26 is released by raising the fastener buckle 30. Also seen in this view is the telescoping legs 14 with the lower legs 36 fully extended outwardly from the upper legs 34. It should be noted that the legs 14 are attached to the housing 12 at an angle from the vertical so that when the legs 14 are lowered, they are at an angle from the vertical to provide a broader angle of support.

Figure 3:
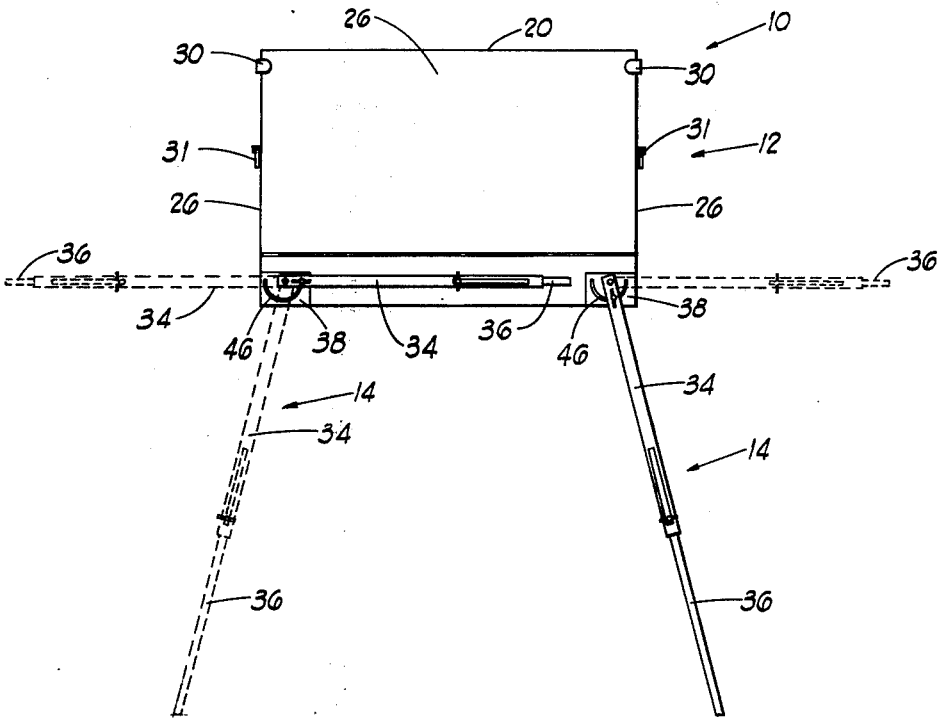
FIG. 3 is a side view of the cabinet table.

In FIG. 3, a side view of the cabinet table 10 is illustrated. In this view the side portions 26 are closed against the housing 12 and secured thereto by the fastener buckles 30. Also seen in this view is the flexibility of the legs 14 with one of the legs positioned adjacent the bottom of the side portion 26 with the other leg 14 in a lowered extended position. The pivoting of the upper legs 34 is made possible by a semi-circular slot 46 in the leg brackets 38. The slots 46 allow the legs 14 to be pivoted 180°. Also shown in dotted lines are the legs 14 extended outwardly in a horizontal position with the lower telescoping legs 36 retracted in the hollow upper legs 34. In this position, the legs 14 may be straddled for carrying the cabinet housing 12 from one location to the other. While the handles 31 may be used for lifting and carrying the cabinet table 10, the legs 14 could be used for carrying the cabinet table 10 when the weight of the supplies in the housing 12 are excessive and it is difficult to carry the cabinet table using the handles 31.

Figure 4:
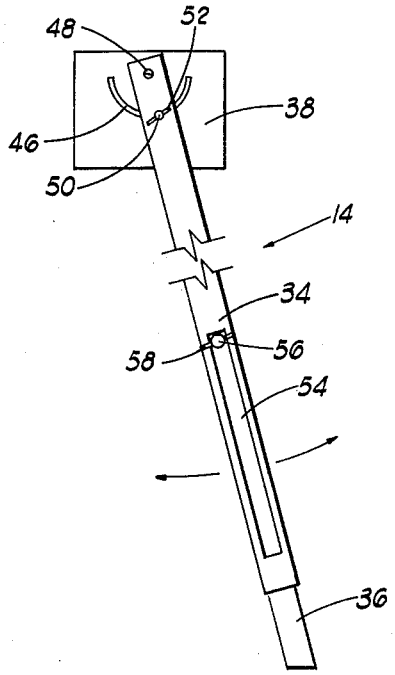
FIG. 4 illustrates one of the telescoping legs with the lower leg in a raised position in the upper leg.

In FIG. 4 an enlarged view of one of the legs 14 is illustrated In this view the semi-circular slot 46 may be seen more clearly with the upper end of the upper leg 34 having a screw 48 or the like pivotally attaching the leg 34 to the bracket 38. Also, a bolt 50 is slidably received in the slot 46 and extends outwardly through the upper leg 34 and secured to a wing nut 52 for adjusting and tightening the upper leg 34 against the side of the bracket 38.

The upper leg 34 also includes an elongated slot 54 for receiving a bolt 56 which is attached to the upper end of the lower leg 36. The bolt 56 receives a wing nut 58 for securing the lower leg 36 to the upper leg 34. In this view the lower leg 36 is retracted in the upper leg 34. In this position the leg 14 is ready to be pivoted against the side portion 26 of the housing 12 or extended outwardly from the housing 12 for carrying the cabinet table 10.

Figure 5:
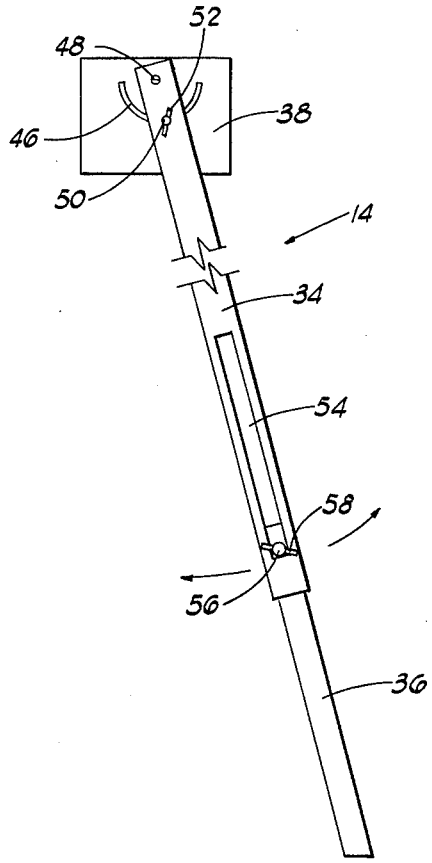
FIG. 5 illustrates one of the telescoping legs with the lower leg extended outwardly from the upper leg.

In FIG. 5 the wing nut 58 has been loosened on the bolt 58 and the lower leg 36 has been telescoped outwardly into an extended position and again tightened on the upper leg 34 by the wing nut 58. By adjusting the lower leg 36 along the length of the slot 54, the overall length of the leg 14 may be adjusted for an unlevel ground surface.

Figure 6:
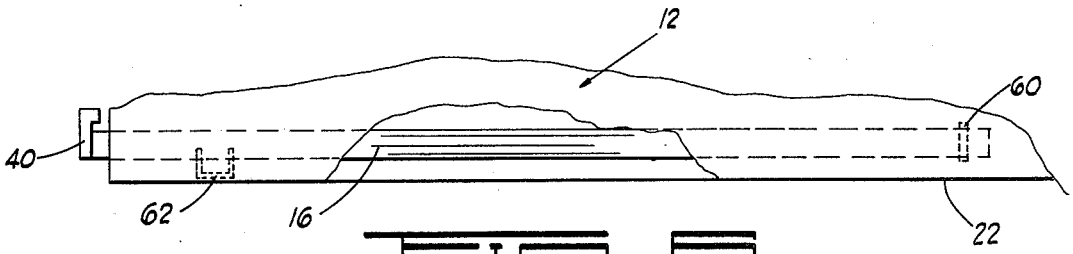
FIG. 6 is a partial view of the bottom of the cabinet housing with a cut-away portion illustrating the retractable extension rods received in the bottom of the cabinet housing.

In FIG. 6 a cut-away portion of the bottom of the housing 12 is illustrated to show the extension rods 16 slidably received in the bottom of the housing 12. The ends of the rods 16 include a circular stop 60 shown in dotted lines and attached to the ends of the rods 16. When the rods are pulled outwardly by the rod support 40, the stop 60 engages a "U" shaped keeper 62 attached to the bottom portion 22 of the cabinet 12 to prevent the rods 16 from being pulled loose from the housing 12.

Changes may be made in the construction and arrangement of the parts or elements of the embodiments as disclosed herein without departing from the spirit or scope of the invention as defined in the following claims.

We claim:

1. A portable picnic and camping cabinet table for storing picnic and camping supplies therein and converting into an outdoor kitchen when set up, the cabinet table comprising:

a cabinet housing having a horizontal shelf therein for storing the supplies, said cabinet housing including a top portion, a bottom portion, end portions, and foldable side portions, the foldable side portions hingeably attached to the bottom of said housing and forming a table surface when folded outwardly and lowered into a horizontal position;

four telescoping legs pivotally mounted at the corners of the bottom of the side portions of said housing, said legs when raised into a horizontal position disposed against the bottom of the side portions of said housing; and a pair of horizontal retractable extension rods slidably received in the bottom of one of the end portions of said housing, said rods when pulled outwardly from said housing supporting a camp stove or the like thereon;

a leg bracket attached to the corners at the bottom of the side portions of said housing, said leg bracket having a semi-circular slot therein for receiving a bolt therethrough, the bolt received through the top of said upper leg and secured to a wing nut for tightening said upper leg to said leg bracket, said semi-circular slot allowing said upper leg to be pivoted from a horizontal position adjacent the side portions of said housing downwardly at various angles from the vertical depending on the level of the ground surface and pivoted outwardly from said housing into a horizontal position for transporting the cabinet table by said legs;

said retractable rods include a tansverse rod support attached to one end of said rods for rigidly supporring siad rods when they are extended outwardly from said cabinet housing and preventing objects from falling outwardly off the ends of said rods; and foldable braces attached at one end to the side portions of said housing and at the other end to the inside of the end portions of said housing, said foldable braces allowing the side portions to be folded outwardly into a horizontal position and bracing the side portions when the side portions are used as a table.

2. The cabinet table as described in claim 1 further including foldable handles attached to the end portions of said cabinet housing for lifting and transporting the cabinet table.

3. The cabinet table as described in claim 1 further including fastener buckles pivotally attached to the end portions of said housing and releasably engaging the top of the side portions of said housing when the side portions are folded against said housing.

4. The cabinet table as described in claim 1 wherein said end portions define a trapezoid.

* * * * *